US005436710A

United States Patent [19]

Uchiyama

[11] Patent Number: 5,436,710

[45] Date of Patent: Jul. 25, 1995

[54] FIXING DEVICE WITH CONDENSED LED LIGHT

[75] Inventor: Tadamitsu Uchiyama, Osaka, Japan

[73] Assignee: Minolta Co., Ltd., Osaka, Japan

[21] Appl. No.: 197,724

[22] Filed: Feb. 17, 1994

[30] Foreign Application Priority Data

Feb. 19, 1993 [JP] Japan ..... 5-030404
Dec. 21, 1993 [JP] Japan ..... 5-322560

[51] Int. Cl.[6] ..... G03G 15/20
[52] U.S. Cl. ..... 355/285; 219/216
[58] Field of Search ..... 355/282, 285, 290; 219/216, 469, 470, 471; 432/60; 346/160.1

[56] References Cited

U.S. PATENT DOCUMENTS 4,434,353 2/1984 Marsh et al. ..... 219/216
5,151,719 9/1992 Akutsu et al. ..... 346/160.1
5,272,504 12/1993 Omura et al. ..... 355/218

FOREIGN PATENT DOCUMENTS 62-222281 9/1987 Japan ..... 355/285
1-38775 2/1989 Japan ..... 355/285
2-221984 9/1990 Japan ..... 355/285
4-265984 9/1992 Japan ..... 355/282
5-27627 2/1993 Japan ..... 355/285

*Primary Examiner*—A. T. Grimley
*Assistant Examiner*—William J. Royer
*Attorney, Agent, or Firm*—Price, Gess & Ubell

[57] ABSTRACT

In the present invention, the fixing device for fixing toner images on a sheet comprises a LED array 1 provided with a plurality of LEDs and a cyrindrical lens 2. The cyrindrical lens 2 is arranged along the LED array 1 to condense the light emitted from the LED array 1 onto the surface of the sheet 3. Therefore, the toner image 8 is fused via heat of the condensed light of the LED array 1 condensed by the cyrindrical lens 2, such that the toner image 8 is fixed onto the surface of the sheet 3.

18 Claims, 6 Drawing Sheets

FIXING DEVICE WITH CONDENSED LED LIGHT

BACKGROUND OF THE INVENTION

1. FIELD OF THE INVENTION

The present invention relates to a fixing device for printers, copying machines and the like used to fix toner images on paper.

2. DESCRIPTION OF THE RELATED ART

Fixing devices of the heating roller type are widely used as fixing devices for fixing toner images on paper. Fixing devices of the heating roller type are provided with a heating source such as an infrared lamp or the like installed within at least one roller among a pair of rollers that come into mutual pressure contact, and fuse the toner image onto a paper sheet interposed between said pair of rollers.

Fixing devices of a flash type are well known as fixing devices that fuse toner images onto paper by a non-contact method. Flash type fixing devices are provided with a flash lamp and reflecting plate such as a reflector or the like, which reflects the light emitted by the flash lamp so as to fuse the toner image onto a sheet by means of the radiant heat of said reflection.

Fixing devices of the heating roller type use rollers having large heat capacity. The surface of the roller must be preheated to a predetermined temperature in order to heat the entire roller via the heating source.

Although fixing devices of the flash type do not require preheating since the toner image is fused onto the paper sheet by fusing said toner via the radiant heat of the light emitted from the flash lamp, heating efficiency is poor, and designing for compactness is difficult.

SUMMARY OF THE INVENTION

An object of the present invention is to provide a fixing device which does not require preheating, has superior heating efficiency, and readily lends itself to a compact design.

In order to eliminate the previously described disadvantages,a the fixing device for fixing toner images on a paper is provided and comprises a light-emitting diode array provided with a plurality of light-emitting diodes, and condensing means for condensing the light emitted from said light-emitting diode array onto said toner images on the paper.

These and other objects, advantage and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

First Embodiment

A first embodiment of the present invention is described hereinafter.

Figure 1:
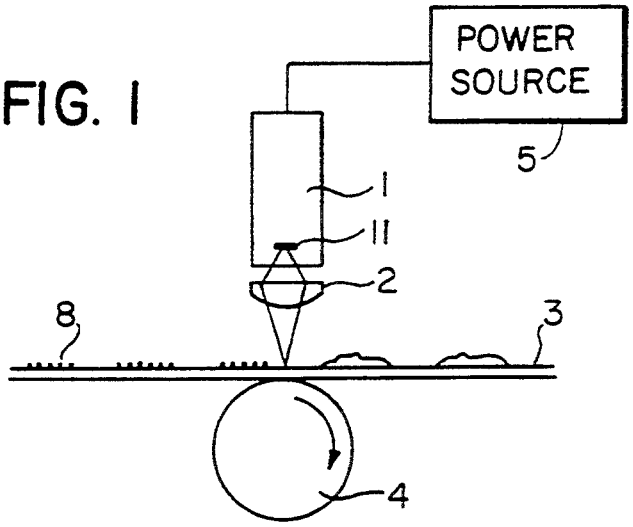
FIG. 1 is a side view briefly showing the construction of a first embodiment of the fixing device.

FIG. 1 is a section view showing the construction of a first embodiment of the fixing device of the present invention.

The first embodiment of the fixing device is provided with a light-emitting diode array (hereinafter referred to as "LED array") 1, and cylindrical lens 2. The LED array 1 is provided with a plurality of LEDs 11 arrayed in a single row in a direction perpendicular to the sheet feeding direction (direction facing from the front side to the back side of the sheet surface in FIG. 1). The length of the LED array 1 is set so as to be longer than the length of a fed sheet 3 in a direction perpendicular to the sheet feeding direction (sheet width direction). The light emitted by the LED array includes infrared light.

The cylindrical lens 2 is arranged along the LED array 1 to condense the light emitted from the LED array 1 onto the surface of the sheet 3. The cylindrical lens 2 possesses a refracting power within a plane perpendicular to the direction of the array of the LED 11, and does not possess refracting power within a plane parallel to said direction of the array of the LED 11. A roller 4 is provided below the fixing device. The roller 4 may be a suction belt provided with a means for suctioning the aforesaid sheet 3. The LED array 1 is connected to an electrical power source 5.

A sheet 3 on which is formed an unfixed toner image 8 is transported by the aforesaid roller 4. The light emitted from the LED array 1 is condensed on the surface of the sheet 3 transported by said roller 4 by means of the cylindrical lens 2. The toner image 8 is fused via the heat of the condensed light of the LED array 1 condensed by said cylindrical lens 2, such that said toner image 8 is fixed onto the surface of said sheet 3.

Figure 2:
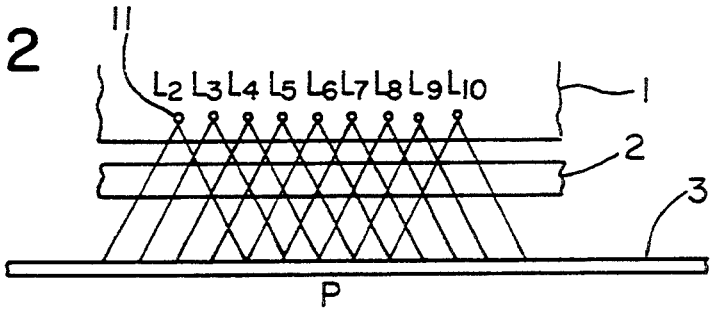
FIG. 2 shows the light distribution of the LED array.

FIG. 2 shows the light distribution on the direction of the LED array of the LED array 1. The cylindrical lens 2 condenses the light emitted by the LED array I within a plane perpendicular to the direction of the array of the LED 11. The cylindrical lens 2 does not condense the light emitted by the LED array 1 within a plane parallel to the direction of the array of the LED 11. Accordingly, the light of a plurality of LEDs designated $L_4 \sim L_8$ attains an optional point P on the surface of the sheet 3. Thus, non-uniformity of the amount of light attaining the surface of the sheet 3 is minute even when there is disparity in the amount of light generated by the individual LEDs 11.

The number of individual LEDs 11 arranged within the LED array 1, and their spacing are described below in terms of specific numerical values.

Infrared LEDs (model number SID1K10CXM, GaAs, wavelength 940 nm, input voltage 1.2 V, input current 50 mA) manufactured by Sanken Denki K. K. were used as the LED 11. Paper sheets A4 in size were transported at a rate of three sheets per minute (18 mm/sec) within the fixing device.

The heat Qt required to fuse the unfixed toner is 0.125 J/cm$^2$, and the shortest edge of an A4 size sheet is 220 mm, such that the heating surface S per unit time is 40 cm$^2$/sec, and the output of the aforesaid LED 11 is 11 mW (standard value). When the light-emitting efficiency $\eta$ of said LED 11 is 18%, and the condensed light ratio $\eta c$ of the condensed light emitted from the LED 11 to the surface of the sheet is 50%, the input power of the LED array 1 is expressed below.

$$\begin{aligned} P &= Qt \cdot S/(\eta_1 \cdot \eta_c) \\ &= (0.125 \times 40)/(0.18 \times 0.50) \\ &= 55.6[W] \end{aligned}$$

When the LED array 1 is constructed based on the aforesaid input power P, the number of individual LEDs 11 arranged within the LED array 1 is 927 because the input power is 60 mW per single LED 11, and the spacing between said LEDs 11 is about 0.2 mm. If an LED is used which requires 150 mW input power, the number of individual LEDs is 371, and the spacing between individual LEDs is about 0.6 mm. If an LED is used which requires 500 mW input power, the number of individual LEDs is 112, and the spacing between individual LEDs is about 2 mm.

Figure 3:
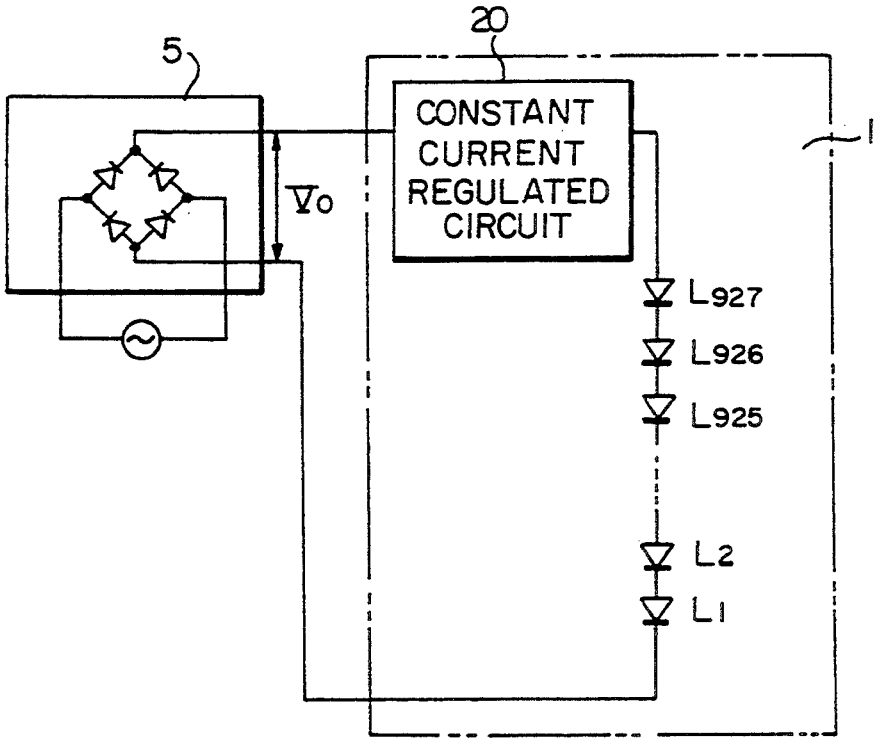
FIG. 3 is a circuit diagram of the power source and LED array.

FIG. 3 is a circuit diagram of the LED array 1 and the power source 5 of the LED array 1.

The LED array 1 is provided with a constant-current regulated circuit 20 to which the 927 individual LEDs $L_1 \sim L_{927}$ are serially connected. The constant-current regulated circuit 20 is connected to a power source 5, which is provided with a rectifier circuit connected to an AC circuit.

When AC power is applied, the power source 5 rectifies the AC power so as to convert it to a DC current voltage $V_O$. The aforesaid DC current voltage $V_O$ is applied to the LED array 1, so as to supply a DC current (constant current) to the LEDs $L_1 \sim L_{927}$ via the constant current regulating circuit 20. Thus, the LEDs $L_1 \sim L_{927}$ emit the light by means of the aforesaid DC current. That is, in the fixing device of the first embodiment, a constant-current is applied from the constant-current regulating circuit 20 to the LED array 1, such that the amount of light emitted by the LED array 1 remains stable even if a temperature fluctuation is generated by the LEDs 11. A constant voltage may be supplied by a constant-voltage power source to the LED array 11, in which case it is desirable to provide a compensating circuit to stabilize the amount of light emitted by said LEDs 11.

Although the 927 individual LEDs are serially connected in the fixing device of the first embodiment, it is to be noted that these LEDs may be divided into a plurality of groups, with a constant-current regulating circuit 20 provided and serially connected to each individual group.

Second Embodiment

A second embodiment of the invention is described hereinafter.

Figure 4:
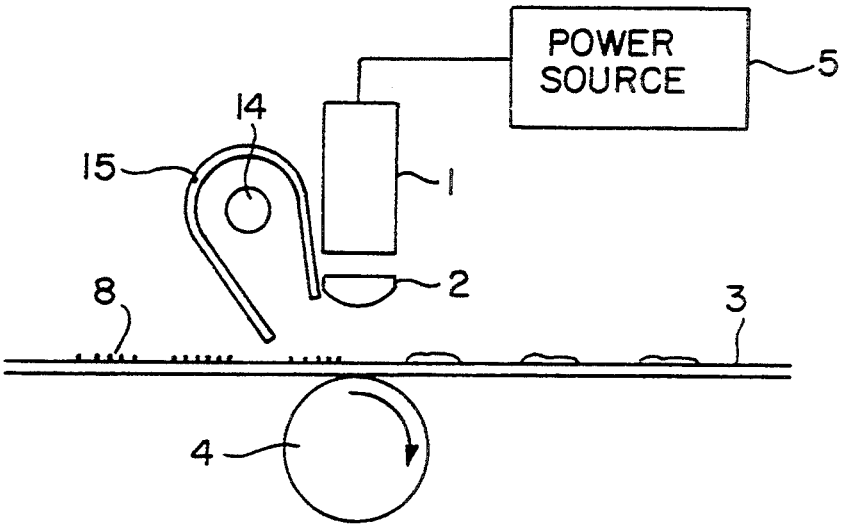
FIG. 4 is a side view briefly showing the construction of a second embodiment of the fixing device.

FIG. 4 shows a second embodiment of the fixing device of the present invention.

The fixing device of the second embodiment is provided with, in addition to the construction described in the first embodiment, a halogen lamp having a reflector 15 disposed on the upstream side of the LED array 1 in the sheet transport direction. The reflector 15 is provided to concentrate the light emitted from the halogen lamp 14 slightly upstream from the condensing position of the light emitted from the LED array 1 in the sheet transport direction. The halogen lamp 14 elevates the temperatures of the sheet 3 and toner image 8 via said light so as to render said temperatures equal.

In the fixing device of the second embodiment, when the sheet 3 with the toner image 8 formed thereon is transported on top of the roller 4, the sheet 3 and the toner image 8 are uniformly heated by the light emitted from the halogen lamp 14. The toner image 8, the temperature of which has been uniformly elevated by the halogen lamp 14, is fused via the light emitted by the LED array 1 which has been condensed by the cylindrical lens 2.

The fixing device of the second embodiment is provided with a halogen lamp 14 disposed upstream from the LED array 1 in the sheet transport direction. The heat generated by the LED array 1 is minimized because the temperatures of the sheet 3 and the toner image 8 have been previously elevated by means of the light emitted by the halogen lamp 14.

In the case wherein the sheet 3 has a moisture content, said moisture content may be reduced via the light emitted from the halogen lamp 14. Thereafter, the toner image 8 may be fused by means of the light emitted by the LED array 1, thereby achieving greater fixing efficiency.

Third Embodiment

A third embodiment of the present invention is described hereinafter.

Figure 5:
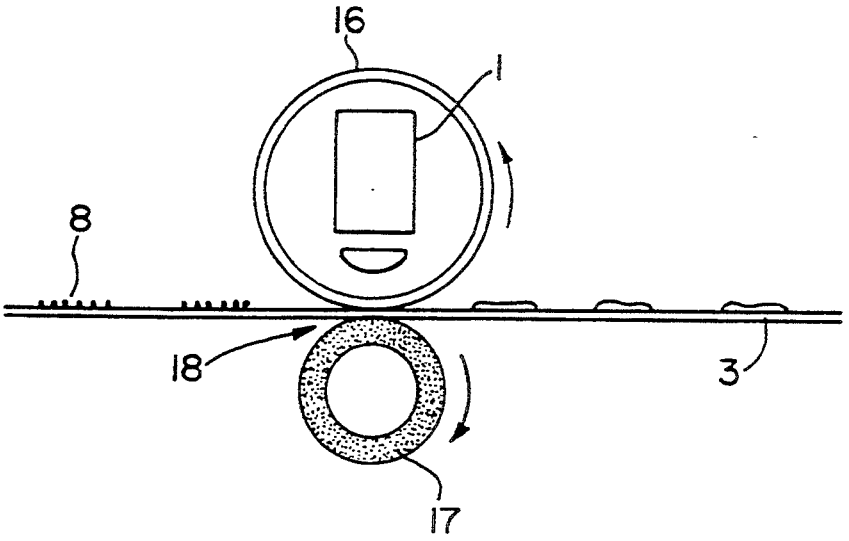
FIG. 5 is a side view showing a third embodiment of the fixing device.

FIG. 5 shows the fixing device of a third embodiment.

In the third embodiment, the construction of the LED array 1 and the cylindrical lens 2 are identical to those described in the first embodiment. In the, fixing device of the third embodiment, the LED array 1 and the cylindrical lens 2 are disposed within a transparent glass roller 16. The transparent roller 16 is in pressure contact with a rubber roller 17, and has a nip portion 18 formed therebetween. The light emitted by the LED array 1 is condensed at the aforesaid nip portion 18 via the cylindrical lens 2. The transparent roller 16 and rubber roller 17 are rotatably driven in the arrow direction via a motor or the like not shown in the illustration, and are provided to transport the sheet 3.

In the fixing device of the third embodiment, when a sheet 3 with a toner image 8 formed thereon is inserted into the nip portion 18, said toner image 8 is fused onto the surface of said sheet 3 via the light emitted from the LED array 1 that has been condensed by the cylindrical lens 2, and the pressure exerted thereon via the pressure contact between the transparent roller 16 and the rubber roller 17.

In the fixing device of the third embodiment, the heat of the heated toner is efficiently transmitted to the unheated toner because said toner image 8 is heated via the light emitted from the LED array 1 that has been condensed by the cylindrical lens 2 in conjunction with the pressure applied to said toner image 8 via the pressure contact between the transparent roller 16 and the rubber roller 17. The aforesaid toner image 8 is reinforcibly fused onto the surface of the sheet 3 by means of the pressure exerted on said toner image 8 via the pressure contact between said transparent roller 16 and said rubber roller 17.

In the fixing device of the third embodiment, a peel-ply layer may be provided on the exterior surface of the transparent roller 16 to prevent toner adhesion thereto. When the exterior surface of the transparent roller 16 is provided with the aforesaid peel-ply layer, said peel-ply layer may absorb the light emitted from the LED array 1 that has been condensed by the cylindrical lens 2, such that the toner image 8 is fixed onto the surface of the sheet 3 via said heated peel-ply layer. When the light emitted by the LED array 1 is absorbed by the peel-ply layer, it is desirable that said peel-ply layer be of thin construction.

Although a transparent glass roller 16 is used in the fixing device of the third embodiment, it is to be noted that alternatively a screen-like metallic roller or resin which allows the transmission of infrared light may be used.

Fourth Embodiment

A fourth embodiment of the present invention is described hereinafter.

The fixing device of a fourth embodiment has a construction identical to that described in the first embodiment (refer to FIG. 1).

In the fourth embodiment, we consider diffusion and dissipation caused by heat conduction when power is applied to the LEDs, for the purpose of improving the efficiency in power supplied by the power source 5.

In general, the heat conduction equation can be expressed as follows.

$$\delta\theta/\delta_t = \alpha^2(\nabla\theta)^2 = \lambda/c\rho\,(\nabla\theta)^2 \quad (1)$$

The equation expressing the temperature elevation of the object is as follows.

$$\alpha^{\theta}dt = Q/c\rho \quad (2)$$

There terms in the aforesaid equations are defined as follows: $\theta$ expresses temperature, t expresses time, $\alpha^2$ expresses thermal conductivity, expresses heat conductivity, $c\rho$ expresses thermal capacity (c being the specific heat, and $\rho$ being density), and Q expresses amount of heat supplied per unit time.

Equation (1) expresses the point at which the rate of variation of temperature relative to time is proportional to the square of the slope of the temperature, i.e., the reduction in the temperature elevation induced by temperature diffusion. Equation (2) expresses the rate of temperature elevation in proportion to the amount of supplied heat per unit time, i.e., inversely proportional to the heat capacity.

Accordingly, in consideration of an equilibrium of the heat flow relative to Equations (1) and (2), it can be understood that when an equal amount of heat is supplied, a target temperature can be attained in a shorter time by applying said heat in pulses until said target temperature is achieved, thereby improving efficiency. It can be understood that gradual heating allows significant heat to escape and achieves only slight temperature elevation, whereas rapid heating achieves superior temperature elevation.

Therefore, in the fixing device of the fourth embodiment, the output current of the power source 5 is supplied to the LEDs in pulses. The pulse output current of the power source 5 is described in detail below.

Figure 6A:
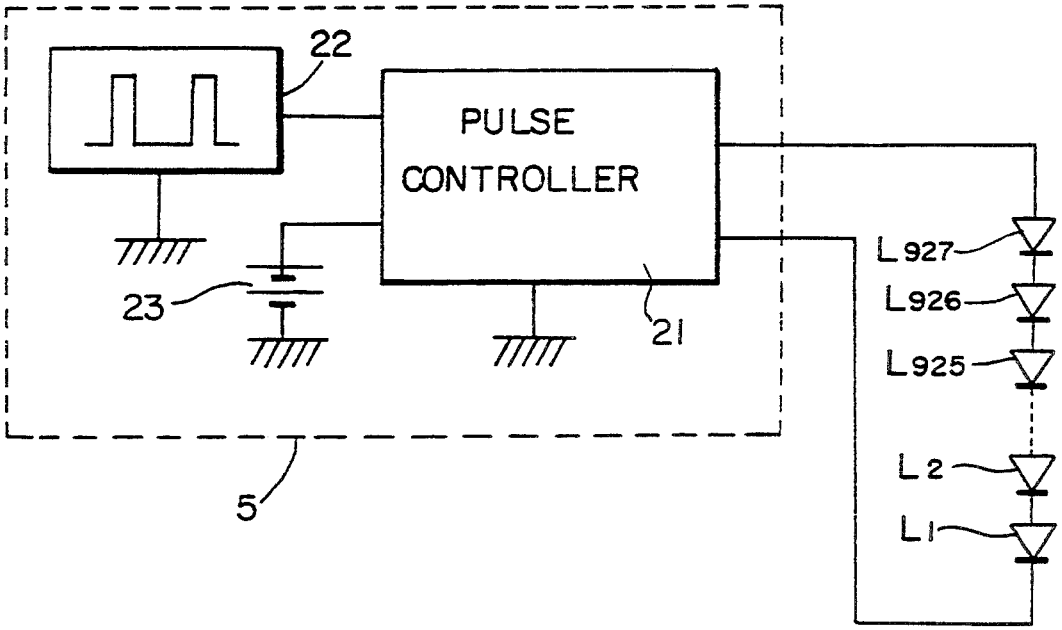
FIGS. 6*a* and 6*b* respectively are a circuit diagram of a fourth embodiment of the fixing device and an illustration showing the wave-forms of the output current of said circuit.
Figure 6B:
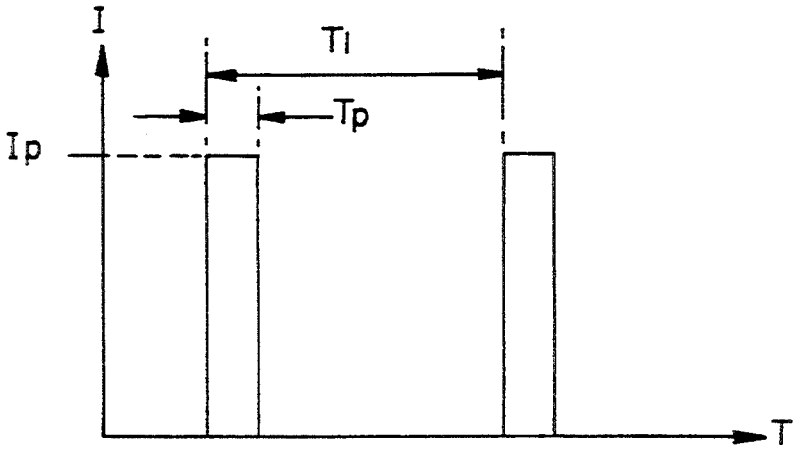

The power source 5 comprises a pulse controller 21, pulse generator 22, and power source 23, as shown in the circuit diagram of FIG. 6a. The pulse controller 21 controls the power output by the power source synchronously with a predetermined pulse generated by the pulse generator 22, such that a pulse-like current is supplied to the individual LEDs $L_1 \sim L_{927}$, as shown in FIG. 6*b*. Thus, the LEDs $L_1 \sim L_{927}$ are lighted pulsingly via the aforesaid pulse current. In the pulse current shown in FIG. 6*b*, the pulse period is designated T1, the pulse width is designated Tp, and the pulse peak current is designated Ip.

Care must be taken that, in the aforesaid pulse: current, the average of the pulse current applied to the LEDs $L_1 \sim L_{927}$ does not exceed the LED rating, and the pulse peak current Ip does not exceed the LED rating.

Figure 7A:
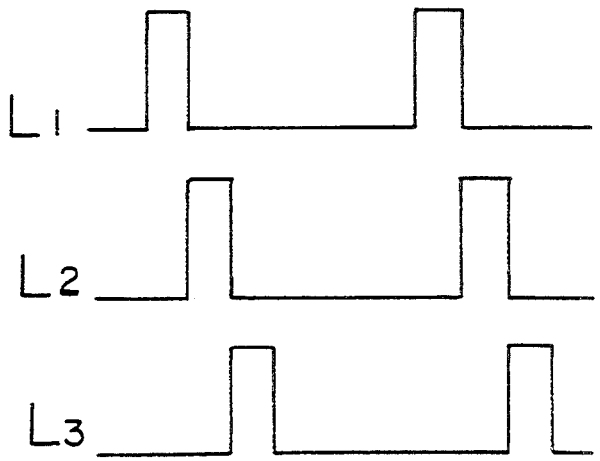
FIGS. 7*a* and 7*b* respectively are a timing chart showing the lighting sequence of the LEDs and the construction of the LED array in a fourth embodiment of the fixing device.
Figure 7B:
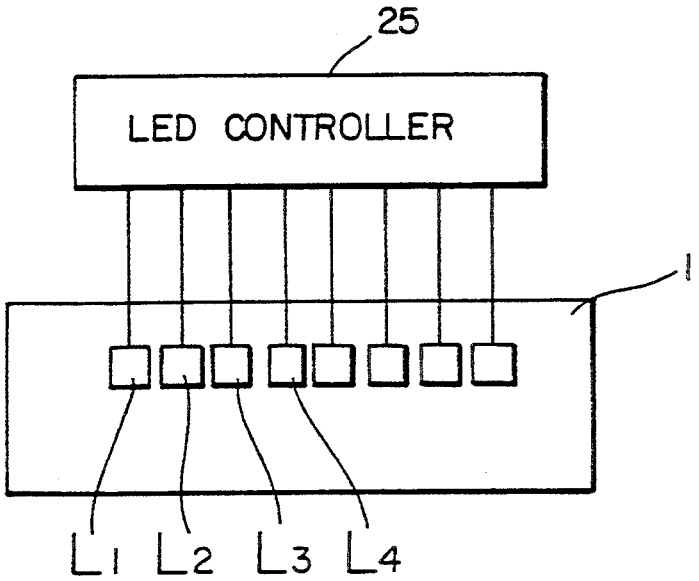

A modification of the pulse lighting of the LEDs 11 of the fourth embodiment is now offered, wherein the LEDs 11 arranged within the LED array 1 in a direction perpendicular relative to the sheet transport direction are sequentially lighted, as shown in FIG. 7*a*. The LED sequential lighting control is accomplished, as shown in FIG. 7*b*, by controlling the ON-OFF switching of the supplied current via the LED controller 25, such that the LEDs 11 are lighted sequentially one by one or block by block. In the LED sequential lighting control, it is possible to minimize the current supplied to the LED array 1 compared to simultaneous pulse-lighting of the LEDs 11. Accordingly, a power source of low power output may be used, thereby achieving a lower cost construction.

A modification of the LED sequential lighting control is now offered, wherein a discrete lighting control is achieved by discretely lighting the LEDs 11 within the LED array 1 such that every other LED 11 is lighted, every several LEDs 11 are lighted. When the LEDs 11 are arranged within the LED array 1 in a plurality of rows, a zigzag-lattice lighting control may be accomplished wherein the lighting of the LEDs in a zigzag lattice-like lighting passing from front row to back row, e.g., when the LEDs of a first row are lighted in a pattern such as ON-OFF-ON-OFF . . . , the LEDs of a second row are lighted in a pattern such as OFF-ON-OFF-ON . . . and the like.

Discrete lighting control and zigzag-lattice lighting control minimize the current supplied by the power source in the same manner as the previously described sequential lighting control, thereby allowing the use of power sources of low power output.

In the fixing device of the fourth embodiment, greater efficiency in the supplied power is achieved by supplying a pulse current to the LEDs. Such an arrangement further reduces heat generation of the power unit, reduces temperature elevation within the body of the device, and allows a fanless construction.

LEDs used as the LED of the fourth embodiment have a light emitting efficiency (amount of emitted light/current) of similar to that of the Yokogawa-Hewlett-Packard LED (model number HLMP-6405) for superior efficacy.

Fifth Embodiment

A fifth embodiment of the present invention is described hereinafter.

Figure 8:
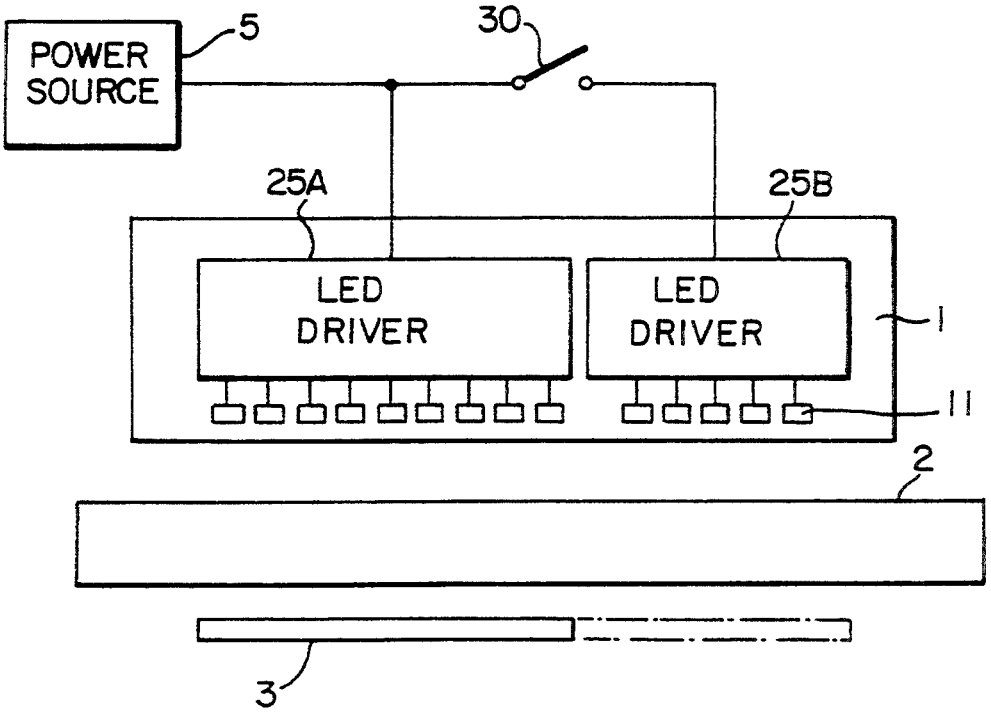
FIG. 8 is a section view showing the surface of a fifth embodiment of the fixing device at a right angle relative to the sheet feeding direction.

The fixing device of the fifth embodiment is substantially similar to that described in the first embodiment. FIG. 8 shows a section view at a plane perpendicular to the sheet transport direction.

As shown in FIG. 8, a plurality of individual LEDs 11 are arranged within the LED array 1 in a direction perpendicular to the sheet transport direction. The plurality of individual LEDs 11 arranged within the LED array 1 are divided into a plurality of blocks corresponding to paper sizes, and are connected to the LED drivers 25A and 25B. The LED drivers 25A and 25B are connected to a power source 5 via a switch 30. Power is supplied from the power source 5 to the LED drivers 25A and 25B driving the LED blocks corresponding to a paper size in accordance with the size of a transported sheet 3.

That is, the fixing device of the fifth embodiment is constructed so as to controllably light only the LEDs of the block corresponding to the paper size without lighting the LEDs of the block that does not correspond to the paper size.

The operation of the fixing device of the fifth embodiment is described with specific examples with reference to FIG. 8. When, for example, the size of the transport sheet (e.g., A4) is large, the switch 30 is turned ON, such that power is supplied from the power source 5 to both LED driver 25A and 25B corresponding to said sheet size. However, when the size of the transported sheet (e.g., B5) is small, the switch 30 is turned OFF, and power is supplied form the power source 5 to only one LED driver 25A.

Accordingly the fixing device of the fifth embodiment consumes less power because power is not supplied to LEDs that are not required for the fixing operation, thereby achieving superior power efficiency. Furthermore, this arrangement avoids the holding of heat outside the fixing region common to conventional arrangements, and specifically eliminates curling and wrinkling of the paper caused by said heat held outside the fixing region when the paper size is changed to a small size sheet directly after a larger size sheet has been fixed.

A modification of the device of the fifth embodiment is now proposed, wherein the individual LEDs 11 are independently driven, such that said individual LEDs 11 are supplied power in accordance with the sheet size. When fixing is desired in only a part of the region within the sheet size, an operator may optionally set the fixing region, such that power is supplied only to the LEDs corresponding to said desire fixing region.

Sixth Embodiment

A sixth embodiment of the present invention is described hereinafter.

In the fixing devices of the previously described embodiments, the light emitted from an LED array 1 is condensed by a cylindrical lens 2, and attains the toner adhered to the surface of a sheet 3 so as to fuse said toner thereon. However, when the light condensed by the cylindrical lens 2 impinges parts of said sheet 3 that do not have said toner, said light is reflected or diffused. That is, the light condensed by the cylindrical lens 2 is wasted.

Figure 9:
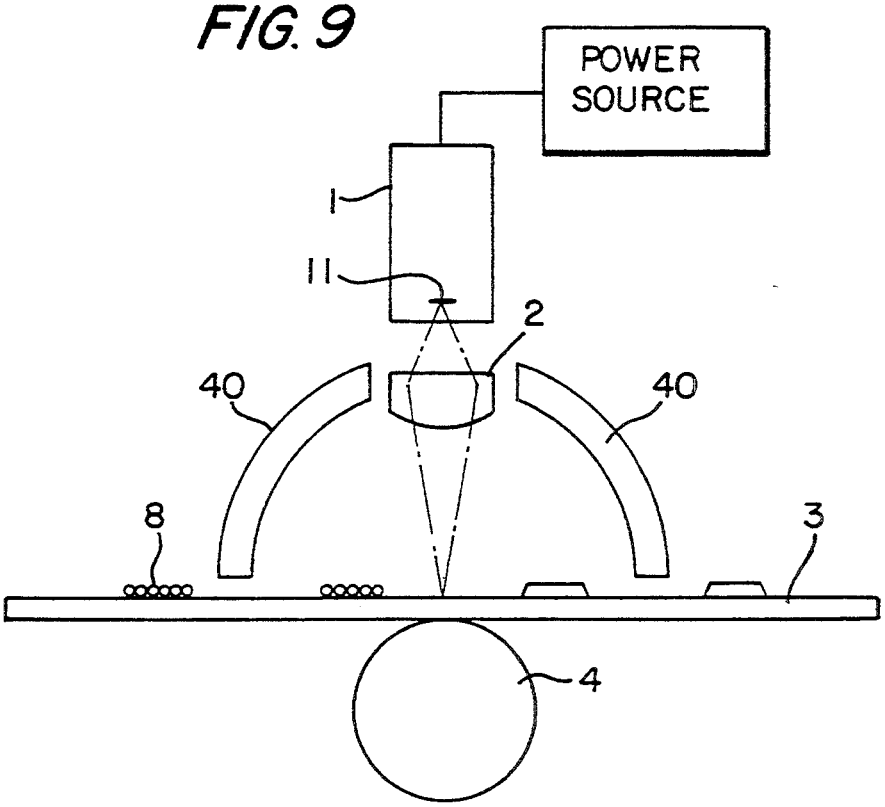
FIG. 9 is a side view briefly showing the construction of a sixth embodiment of the fixing device.

The fixing device of the sixth embodiment is provided with, in addition to the construction described in the first embodiment, a reflector plate 40 disposed in proximity to the cylindrical lens 2, as shown in FIG. 9. The light reflected or diffused at those parts of the sheet 3 that do not have toner is again condensed onto the surface of said sheet 3 by means of the reflecting plate 40.

Methods of forming the reflecting plate include forming a curved surface of aluminum as the reflecting surface, and providing an infrared reflecting layer of copper or the-like on a transparent member made of glass, film or the like, as shown in FIG. 9. Furthermore, a recurrent reflecting plate of the bead type such as in use in din road sign may be used.

Accordingly, the fixing device of the sixth embodiment achieves excellent fixing efficiency, and is a low power consumption device inasmuch as the power supplied by the power unit is used efficiently.

The fixing devices of the first through sixth embodiments do not require preheating because the light emitted from the LED array 1 is condensed by a cylindrical lens 2, and is then used to fuse the toner image 8 onto the surface of the sheet 3.

It is to be understood that the LEDs 11 arranged in the LED array 1 are not limited to an arrangement of a single row, and may be arranged in a plurality of rows In the previously described embodiments, the lens for condensing the light emitted from the LED array 1 is a cylindrical lens 2 that condenses light within a plane perpendicular to the direction of the arrangement of LEDs 11, and does not condense the light within a plane parallel to the direction of arrangement of the LEDs 11. It is to be noted, however, that alternatively a lens may be used that also condenses the light emitted from the LED array 1 within a plane parallel to the direction of arrangement of the LEDs 11 as well as within a plane perpendicular to the direction of arrangement of said LEDs 11.

Furthermore, a heat dissipation member such as a fan or the like may be provided at the LED array 1 to improve heat dissipation.

Seventh Embodiment

A seventh embodiment of the present invention using an LED head 70 configuration is described hereinafter.

Figure 10:
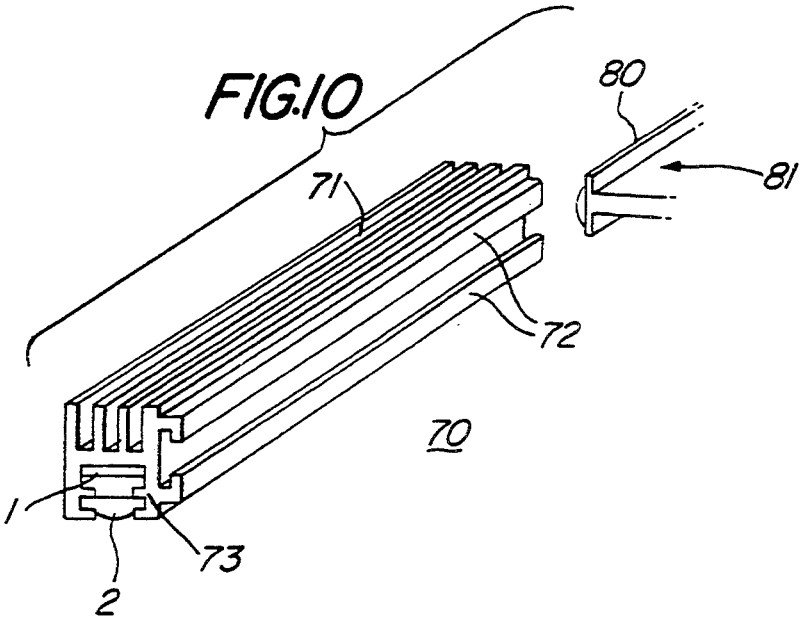
FIG. 10 is a perspective view showing the construction of an LED head of a seventh embodiment of the fixing device.

As shown in FIG. 10, the LED head 70 is a unit integratedly formed by heat dissipating fins 71 for dissipating the heat of the LED head 70, and mounting guide 72 for mounting the LED head 70 on the body of the device. The mounting guide 72 accommodates the installation of the LED head 70 by engaging the exterior sides of the guide 81 of the image forming device body. The LED head 70 is precisely positioned by means of a spring 80.

An LED array 1 provided with a plurality of LEDs 11 is fixedly mounted on the LED head 70 by means of a strong heat-conducting adhesive, and a condensing lens 2 is positioned and fixedly mounted on a holder 73 of said LED head 70.

Figure 11:
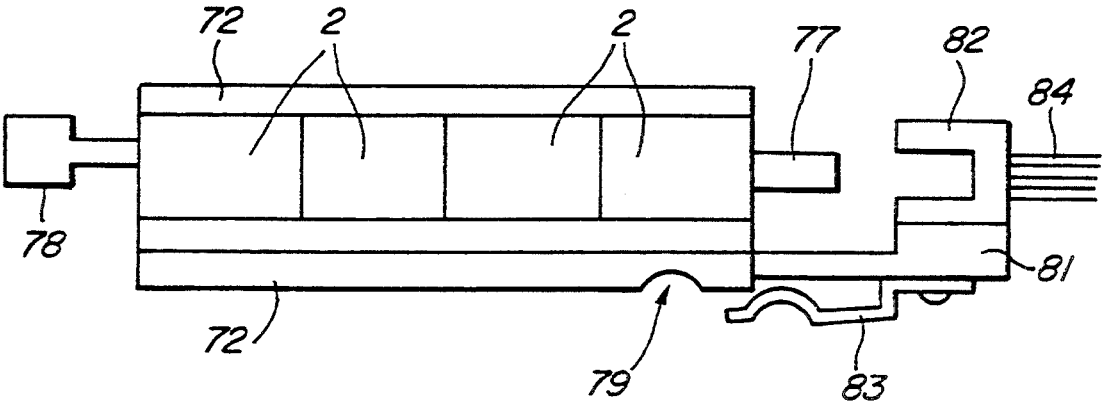
FIG. 11 shows the construction of an LED head of a seventh embodiment of the fixing device.

FIG. 11 shows the LED head 70 from a paper side perspective. A connector 77 is provided at the end surface of the LED head 70 upstream of the installation direction. A connector receptacle 82 is provided on the side of the device body at a position confronting the connector 77. A cable 8 is connected to the connector receptacle 82 to supply power from the power source. That is, the connector 77 and the connector receptacle 82 are electrically connected when said connector 77 is inserted into said connector receptacle 82, such that power can be supplied from the power source 5 to the LEDs 11.

A concavity 79 is provided at the mounting guide 72 on the LED head 70 upstream in the installation direction, and a click plate 83 is provided on said guide 81 to stop the concavity 79. Accordingly, the installation of the LED head 70 into the body of the device is locked by means of the aforesaid concavity 79 and said click plate 83. It is to be noted that the mechanism for locking the LED head 70 in the body of the device is not limited to the aforesaid arrangement of concavity 79 and click plate 83, and other mechanisms may be used to similar effect.

Furthermore, a handle 78 may be provided on a part of the LED head 70 or heat dissipating fins 71 on the end surface on the opposite side relative to the connector 77 so as to render the LED head 70 readily detachable. When strip, like cylindrical lens 2 is constructed by bonding a plurality of individual members in the sheet width direction, the cost of construction of the cylindrical lens 2 is readily reduced.

According to the previously described construction, the attachment and locking of the LED head 70 to the body of the device is readily achieved without requiring focusing adjustment of the condensing lens 2 or LED array 1.

The present invention provides a fixing device capable of fixing a toner image onto the surface of a paper sheet by condensing the light emitted by a plurality of light-emitting diodes provided in a light-emitting diode array, and does not require preheating, thereby improving heat efficiency and compact design.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device for fixing toner images on a paper comprising:

light-emitting diode array provided with plurality of light-emitting diodes; and condensing means for condensing the light emitted from said light-emitting diode array onto said toner images on the paper.

2. The fixing device according to claim 1, wherein said plurality of light-emitting diodes is set in a direction perpendicular to a sheet feeding direction and serially connected to a constant-current regulated circuit.

3. The fixing device according to claim 1, wherein said condensing means is a cylindrical lens constructed by bonding a plurality of individual members in a direction perpendicular to a sheets feeding direction.

4. The fixing device according to claim 1, further comprising:

control means for lighting pulsingly said plurality of light-emitting diodes.

5. The fixing device according to claim 4, wherein said control means lights pulsingly said plurality of light-emitting diodes in accordance with a size of a transported sheet.

6. The fixing device according to claim 5, further comprising:

setting means for setting an optionally fixing region, including less then the total number of light-emitting diodes, wherein said control means light pulsingly only the light-emitting diode corresponding to said optionally fixing region set by said setting means.

7. The fixing device according to claim 1, further comprising in proximity to said condensing means;

a reflector for reflecting the light reflected or diffused at the paper.

8. The fixing device according to claim 1, further comprising;

heating means for uniformly heating said paper and said toner images.

9. The fixing device according to claim 8, wherein said heating means is a halogen lamp disposed upstream from said light-emitting diode array in a sheet transport direction.

10. A fixing device for fixing toner images on a paper comprising:

a transparent glass roller including a light-emitting diode array provided with a plurality of light-emitting diodes and condensing means for condensing the light emitted from said light-emitting diode array, and a roller contacting with said transparent glass roller and having a nip portion formed therebetween.

11. The fixing device according to claim 10, wherein said condensing means condenses the light emitted from said light-emitting diode array onto said nip portion.

12. The fixing device according to claim 10, further comprising:

a peel-ply layer on the exterior surface of said transparent glass roller for preventing toner adhesion thereto.

13. A fixing device for fixing toner images on a paper comprising:

light-emitting diode array provided with a plurality of light-emitting diodes;

condensing means for condensing the light emitted from said light-emitted diode array onto said toner images; and a light-emitting diode head for positioning and fixedly mounting said light-emitting diode array and said condensing means, and for unifying a heat dissipating member or dissipating the heat thereof and a guide member for mounting a body of the fixing device relative to a path of transportation for the paper

14. A fixing device for fixing toner images on a paper, comprising:

means for transporting paper with toner particles adhering thereto;

a first light source above the means for transporting for preliminarily pre-heating the toner particles and paper; and a second light source of an LED array positioned downstream of the first light source for fusing the toner particles onto the paper.

15. A fixing device for fixing toner images on a paper, comprising:

means for transporting paper with toner particles adhering thereto;

a plurality of LEDs arrayed across the means for transporting paper, including a plurality of LEDs arrayed along and above means for transporting paper;

means for directing the light from the LEDs to the toner particles and paper; and means for pulsing selective ones of the LEDs in a predetermined order to fuse the toner particles onto the paper.

16. The fixing device according to claim 15 wherein the means for pulsing drives every other LED.

17. The fixing device according to claim 15 further including a reflector member positioned below the plurality of LEDs and above the means for transporting paper to re-reflect light reflected from the paper.

18. The fixing device accordingly to claim 15, wherein the means for directing includes means for condensing the light from the LEDs onto the toner particles.

* * * * *